United States Patent [19]

Zan

[11] Patent Number: 4,952,129

[45] Date of Patent: Aug. 28, 1990

[54] PLANT TO MANUFACTURE ELONGATED ELEMENTS OF PRESTRESSED REINFORCED CONCRETE

[75] Inventor: Amilcare Molin Zan, Milano, Italy

[73] Assignee: S.C.A.C. Societa Cementi Armati Centrifugati SpA, Milan, Italy

[21] Appl. No.: 188,201

[22] Filed: Apr. 29, 1988

[51] Int. Cl.[5] ..... B28B 15/00; B28B 23/06

[52] U.S. Cl. ..... 425/88; 249/86; 264/228; 425/111; 425/122; 425/259; 425/439

[58] Field of Search ..... 425/64, 88, 111, 117, 425/123, 259, 261, 439, 447, 121, 122; 249/86; 264/228, 229, 333

[56] References Cited

U.S. PATENT DOCUMENTS

| | | | |
|---|---|---|---|
| 1,531,739 | 3/1925 | Denison | 425/88 |
| 2,511,761 | 6/1950 | Barber et al. | 425/111 |
| 2,655,708 | 10/1953 | Eschenbrenner | 425/111 |
| 3,305,907 | 2/1967 | Baker | 425/111 |
| 3,577,610 | 5/1971 | Margolin | 425/111 |
| 3,825,394 | 7/1974 | Pietrowiak | 264/228 |
| 3,994,657 | 11/1976 | Minegishi | 425/88 |
| 4,061,454 | 12/1977 | Borcoman | 425/111 |
| 4,242,071 | 12/1980 | Stinton | 425/111 |
| 4,255,104 | 3/1981 | Stinton | 425/111 |

FOREIGN PATENT DOCUMENTS

| | | | |
|---|---|---|---|
| 880411 | 9/1971 | Canada . | |
| 1812499 | 7/1969 | Fed. Rep. of Germany . | |
| 3027046 | 2/1982 | Fed. Rep. of Germany . | |
| 1274339 | 9/1961 | France | 425/111 |
| 1407190 | 6/1965 | France | 425/111 |
| 2385510 | 3/1977 | France . | |
| 2388654 | 4/1978 | France . | |
| 572388 | 10/1945 | United Kingdom | 425/111 |
| 572390 | 10/1945 | United Kingdom . | |
| 572390 | 10/1945 | United Kingdom . | |
| 674780 | 7/1952 | United Kingdom | 425/111 |
| 853073 | 11/1960 | United Kingdom . | |
| 1521755 | 8/1978 | United Kingdom . | |
| 2113600A | 8/1983 | United Kingdom | 425/111 |

*Primary Examiner*—James C. Housel

*Attorney, Agent, or Firm*—Venable, Baetjer & Howard

[57] ABSTRACT

A plant to manufacture elongated concrete elements, particularly railway sleepers of prestressed reinforced concrete. In the plant according to the invention, the forms for the production of said elements are supported on carriages sliding along parallel side-by-side tracks, and the operating machines designed to perform in succession a series of operations on said forms are positioned into a limited working area, housed inside a shed, and are mounted above said tracks, substantially fixed in respect of the longitudinal axis of the tracks but movable transversely thereto. The curing area for the concrete elements is arranged externally to the working area. In the case of prestressed reinforced concrete elements, the tensioning device for the reinforcement strands are mounted directly on each of said slidable carriages supporting the forms.

15 Claims, 8 Drawing Sheets

M
D
H
P1
P2
P3
P4
P5
P6
A
B
C
10
11
12
13
14
14.1
14.2
14.3
14.4
14.5
14.6
23
25
26
28a
28b
30
31
33
38
39
40
41
42
43
44
45
46

4
14
14a
14b
14c
13
13a
15
16
17
18
19
19a
19b

PLANT TO MANUFACTURE ELONGATED ELEMENTS OF PRESTRESSED REINFORCED CONCRETE

BACKGROUND OF THE INVENTION

It is known that the production of prestressed reinforced concrete elements with "adhering wires" (particularly in the form of elongated elements, as beams, rafters, cakes) is carried out throughout the world, since several decades, with very similar methods; the characteristics of a conventional plant and of its working can be summed up as follows:

(a) A track or bench is prearranged—which can be a simple floor, usually of considerable length (for instance, from 40 to 200 m)—at both ends of which there are provided anchorage and reaction devices capable of standing horizontal forces.

(b) The loose reinforcements, the inserts, the forms, the separation elements between successive concrete units and whatever else is needed before the casting, are arranged along the whole track in the required amount and positioning.

(c) Prestressing wires (or plaits, or strands) are stretched out along the whole track, in a number and positioning corresponding to the requirements of the concrete units being produced. Said wires are fixed to the anchorage devices and tensioned, at the stress values foreseen according to the predetermined prestress conditions of the concrete units being produced.

(d) Concrete casting is performed.

(e) The concrete is left to cure for the required amount of time.

(f) After opening or removing the forms, the tension on the wires in correspondence of the end anchorage devices is gradually released, thereby prestressing the prefabricated elements.

(g) The wires between each concrete unit are cut, thus finally separating them.

(h) The finished concrete units are removed from the track and stored.

(i) The track and the forms are properly cleaned, prearranging the plant for a new production cycle.

From the above description it is quite evident that the traditional manufacturing method has a marked feature of discontinuity, mainly due to the fact that the step outlined in (e) determines a practically complete stoppage of the plant for a period of at least 8 to 12 hours, that is, the time actually required for the curing of the concrete. The fact that one should succeed, in many cases, in operating so that the curing period should coincide with the overnight stoppage of the plant, is certainly not apt to reduce the discontinuousness of the production.

Nevertheless, the production drawbacks of such a manufacturing technique are not limited to said feature of discontinuity, but are also tied to the presence of a high number (even 400) of concrete units being produced on a single track, and of a large number of expensive self-propelled machines being used for the different operations, but remaining out-of-work for a long time as they each operate in turn for a period usually not exceeding 45 to 75 minutes throughout the daily production cycle. On the other hand, said machines must have a high capacity in order to perform their work in a short length of time. For example, the machine for preparing concrete should have a capacity of at least 30 $m^3/h$, though working for about 60 to 70 minutes a day: concrete casting in the forms must in fact be rapidly carried out, since the curing period (which has to pass before loosening the anchorage devices and which, as far as production is concerned, is a dead period) starts to run from the casting of the last form.

It is also evident that, by allowing the curing to take place overnight—thus organizing the production cycle so that casting is performed at the end of the normal day shift—it could happen that a failure or other inconvenience preventing to complete the casting could determine an overall postponement of the curing period, thereby causing heavy production losses, upsetting of the working times and difficulties in resetting the normal working cycle.

The object of the present invention is to realize a plant for the production of elongated elements of prestressed reinforced concrete, particularly railway sleepers of prestressed concrete, apt to eliminate the aforementioned drawbacks, to drastically reduce plant and production costs, to make a more rational use of labour and of the operating machines, and to achieve a sufficient continuity of the manufacturing process.

A plant apt to satisfy some of these requirements is described for example in the GB-A-572 390, wherein the forms are mounted sliding along parallel tracks and the tensioning reinforcements, particularly the tensioning wires, are fixed to the ends of the plant, the forms being thus slidable along the same. A serious drawback of this plant is nevertheless actually determined by the fact that the forms slide in respect of the tensioning wires, whereby the wires practically move through the concrete cast in the forms which is already starting to set; this first of all causes problems of final bond (adherence) between the reinforcements and the concrete mass. Furthermore, also the operation of the plant is quite complicated, since the forms of one track and the respective reinforcements stretched out through the plant remain in position for the whole concrete curing period, thereby interferring with the operations being carried out on the forms of another track.

SUMMARY OF THE INVENTION

It is therefore a specific object of the invention to realize a plant apt to eliminate the above drawbacks. For this purpose, the plant according to the invention—which comprises a plurality of elongated forms, positioned parallely one beside the other, and aligned and slidable lengthwise, tensioning means to stretch reinforcement and prestressing strands throughout the length of the aligned forms, as well as a series of operating machines designed to perform in succession a series of operations on the forms—is essentially characterized in that it also comprises a plurality of parallel longitudinal tracks along which slide elongated support carriages, in that each of said carriages supports at least one set of forms aligned lengthwise, in that at least part of said tensioning means for the reinforcement strands are mounted directly on said carriages, and in that the operating machines are positioned into a limited working area and are mounted above said tracks, substantially fixed in respect of the longitudinal axes of the tracks, but movable transversely thereto, the curing area for the concrete elements being arranged externally to the working area.

BRIEF DESCRIPTION OF THE DRAWINGS

Further characteristics and advantages of the present invention will anyhow be evident from the following description of a preferred embodiment thereof, illustrated by way of example on the accompanying drawings, in which.

DESCRIPTION OF THE PREFERRED EMBODIMENT

To allow a full understanding of the invention, a description is given of a typical production of elongated concrete units, and precisely the production of concrete railway sleepers, which have now been replacing for many years the wooden sleepers for various reasons. The present description refers to this typical production both in describing the known technique and in describing the plant according to the invention. It is however understood that the reference to this production is a mere example and does not limit the scope of the invention.

The prestressed concrete railway sleepers typically consist of prismatic bodies of elongated shape (about 2.5 m), usually prestressed by means of four prestretched harmonic steel strands, and provided with special inserts prearranged for fixing the rails.

Figures 1, 2:
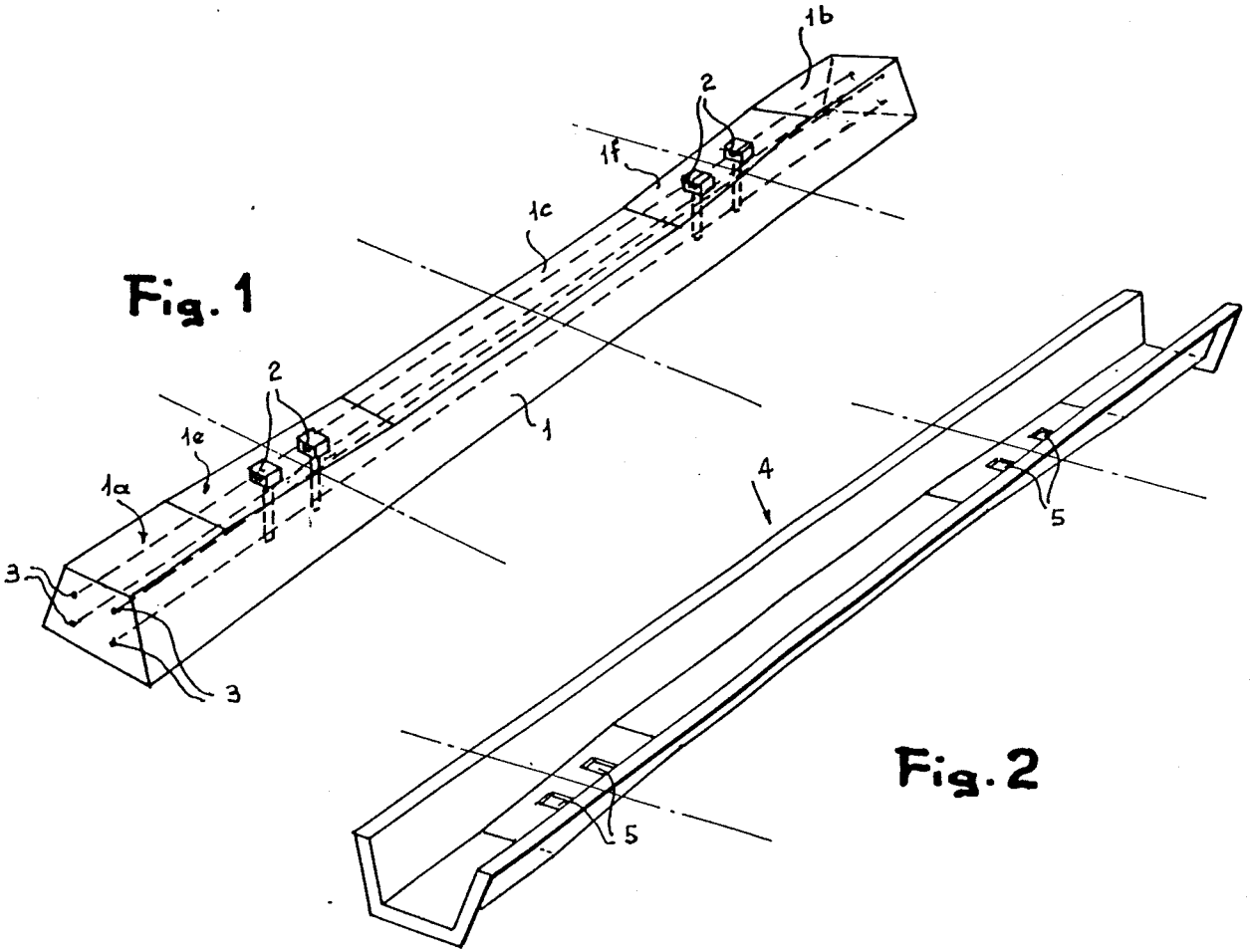
FIG. 1 is a diagrammatic perspective view of a railway sleeper, forming a typical elongated element to be produced in the plant according to the invention.
FIG. 2 is a diagrammatic perspective view of a form used for producing the sleeper according to FIG. 1.

FIG. 1 diagrammatically illustrates such a railway sleeper 1, which has a slightly trapezoidal cross section and the upper surface of which comprises two horizontal end portions 1*a* and 1*b* and a horizontal central portion 1*c*, as well as two intermediate portions 1*e* and 1*f* which are slightly inclined towards the centre and in correspondence of which there are formed seats 2 for housing the means (not shown) for fixing the rails (also not shown).

Said sleeper 1 comprises a metal reinforcement consisting, for example, of four parallel elements 3 which, according to the techniques now mostly used, consist of strands or plaits of harmonic steel. Such strands are prestretched before casting the concrete and they are released after curing of the concrete, that is, after this latter has reached the required strength. It is normally not necessary to provide for anchorage elements at the two ends of the sleeper, since its prestressing is guaranteed by the simple bonding of the strands 3 to the concrete. Consequently, when the concrete has cured, the strands 3 can be cut along the end surfaces of the sleeper, as mentioned above, without providing for any other special anchorage.

To produce a sleeper, as that illustrated in FIG. 1, use is made of a form as shown in FIG. 2. Said form 4 (usually of metal) has longitudinal walls flaring upwards and the sleeper is formed therein upside-down; one thus takes advantage of the trapezoidal section of the sleeper to obtain an easier shakeout, without having to provide for a system to open the form itself. For this purpose, as clearly shown in the drawing, the bottom of the form has a section corresponding to the upper surface of the sleeper.

Said arrangement also allows to fix inserts into the bottom of the form with utmost precision; said bottom is in fact provided with holes or seats 5, into which are temporarily fixed said inserts, usually of steel or molded plastic, designed to form the means for fixing the rails.

Since the sleepers are about 30 cm wide, the respective forms are preferably positioned one beside the other, in a number varying from 2 to 12, so as to carry out an easier mass production. An example of a quadruple form 4 is diagrammatically illustrated in FIG. 3.

Figure 3:
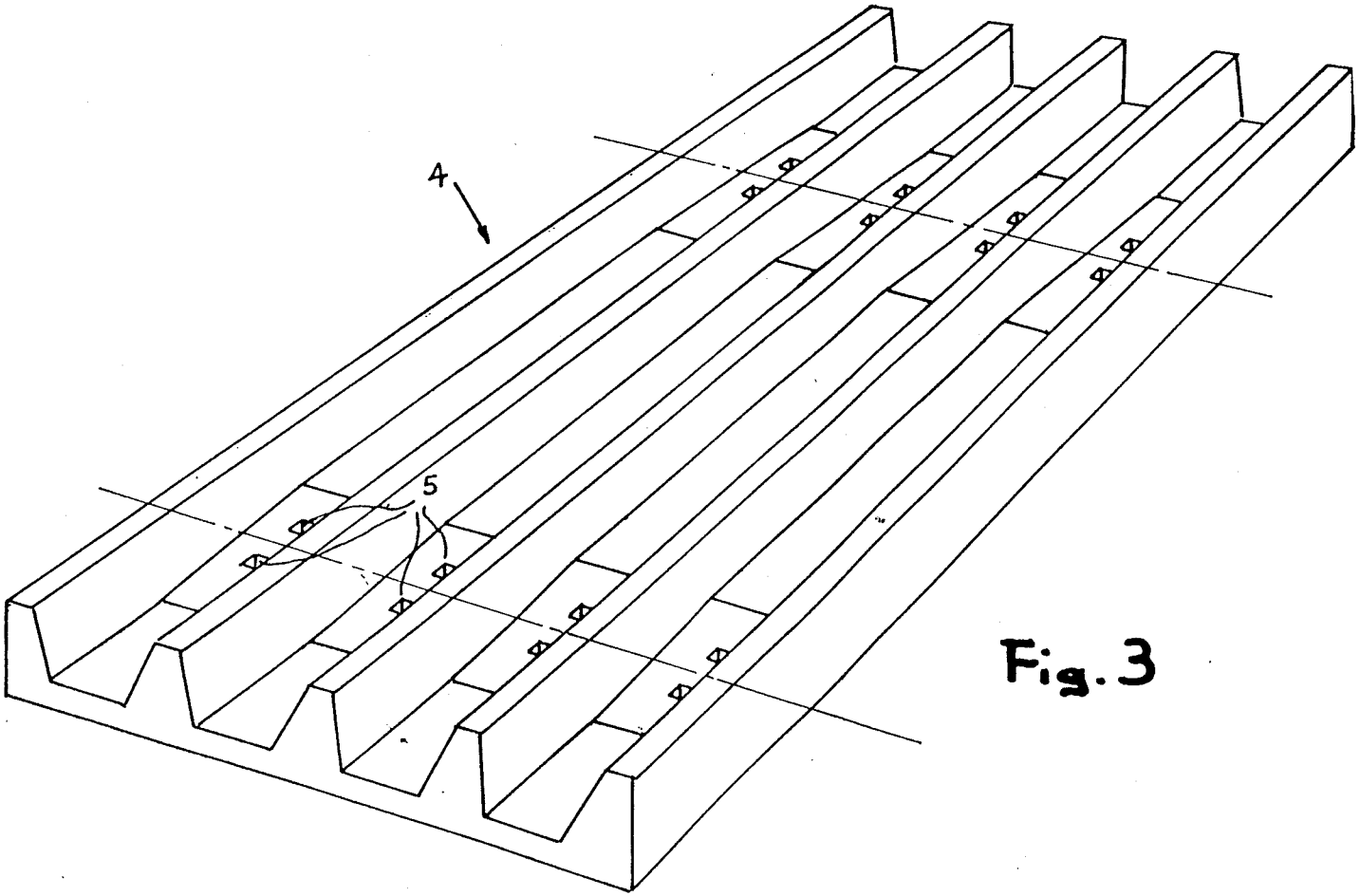
FIG. 3 is a view similar to that of FIG. 2, showing a different embodiment of a form for railway sleepers.

Both in the case of the single form of FIG. 2, and in the case of the multiple forms of FIG. 3, their end parts are always open. This allows to align several forms along the length of the working track, interposing between the adjacent ends of the forms removable separation baffles, the double function of which will be better described hereinafter.

The production cycle takes place as follows:

(a) After preparing a track or bench, as already mentioned, a plurality of forms 4 is aligned along said track, positioned one after the other on suitable longitudinal guides—the number of said forms varying according to the length of the track (for instance, 50 forms for standard sleepers of 2.50 m are aligned along a track of 120–130 m)—leaving between said forms a short space 4' (for instance of 1 cm) to insert baffles having the double function of:

keeping the forms mutually spaced, for instance by about 1 cm, so that, on drawing out the baffles (when the concrete has already lost its fluidity, but before it has completely set), there remains a free space to insert a cutter for cutting the strands;

supporting the prestressing strands in the correct position, both vertically and horizontally, in respect of the form.

Figure 4A:
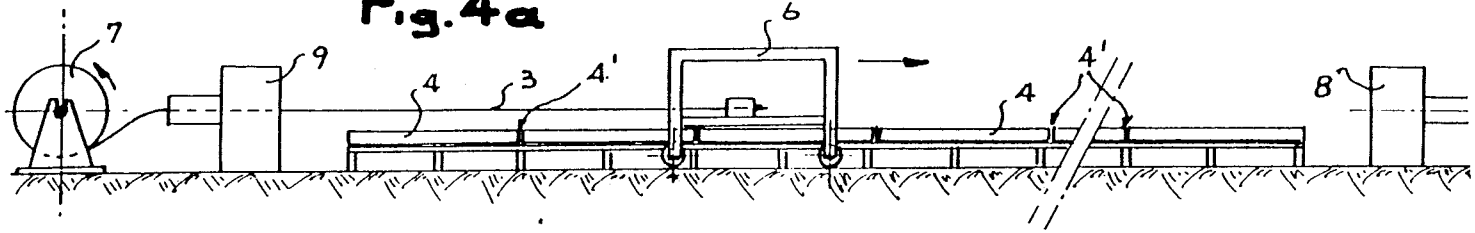
PRIOR ART Fig. 4a
FIGS. 4*a*, 4*b* and 4*c* are, respectively, a longitudinal, a partial cross section and a plan view, showing the diagram of a production plant according to known technique.
Figure 4B:
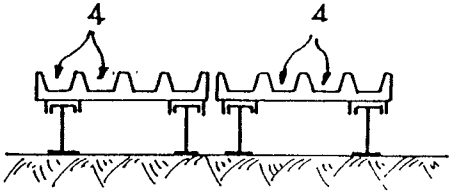
Fig. 4b PRIOR ART
Figure 4C:
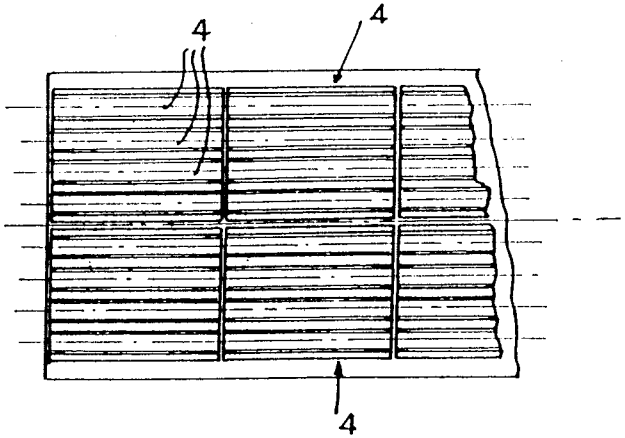
Fig. 4c PRIOR ART

(b) After aligning the forms along the track, the strands 3 (for quadruple forms, 16 strands are generally used) are stretched from one end to the other of the track, using a special car 6 which slides astride the forms and draws one end of the strands towards an end of the track, while such strands are being unwound from skeins 7 positioned at the other end of the track (diagram of FIG. 4*a*). When the car 6 has reached the end of the track opposite to that of the skeins 7, the far ends of the strands are tied to anchor plates 8 and 9; pulling devices (of the hydraulic jack type, not shown) are then operated in correspondence of one of said anchor plates, so as to tension the strands 3 according to the required prestress values.

(c) Centering and separation baffles are then inserted into the spaces 4' between the forms 4, as well as all the inserts for fixing the rails and any other elements required before the casting. This operation is also performed by means of a suitable car carrying the baffles and the inserts and moving along the track with the operator or operators.

(d) The concrete casting is finally performed with a spreading hopper (periodically filled with concrete by external self-propelled means), which continuously pours the material into the forms. Also said hopper travels astride the forms and comprises supplementary tamping and leveling means.

(e) When the concrete has started to harden, but before its setting, the baffles are removed, leaving the strands in the short space 4' between each form uncovered. To draw out the baffles, one normally uses a suitable self-propelled car provided with jacks for crosswise removal, onto which all the baffles are heaped up. Said baffles are then thoroughly cleaned.

(f) One waits for the time required for the curing of the concrete to take place. The curing is practically always forced by heating. This is done by laying—with the help of a car with swift—an insulating sheet over the whole casting, after it has been performed, and by subsequently removing said sheet before the next step.

(g) The anchor devices for the strands 3, at both ends of the track are then loosened.

(h) With a suitable self-propelled machine—which also moves astride the track and which carries a disk saw—the bare strand lengths are cut between each form, thus separating the forms with the sleepers housed therein.

(i) With another self-propelled machine, equipped with a device for seizing the sleepers (usually having suckers), the sleepers are drawn out of the forms and overturned, and subsequently stored.

(l) The track and the forms are then cleaned—the forms being also lubricated—with a suitable self-propelled machine, prearranging the plant for a new production cycle.

In substance, the plants according to known technique provide for the use of a wide and considerably long track, with a fixed structure of forms and a plurality of operating machines being shifted along said track to perform the different operations on the forms.

As can be easily understood, and as besides mentioned further above, these known plants have at least two main serious drawbacks:

On one hand, they require considerably large worksheds, to cover the whole track and the surrounding working area; it should be noted that, for example for a track of 130 m with 6 to 12 side-by-side rows of forms—as mentioned above—the shed should have a length of at least 150 m and a width such as to hold, on both sides of the track, sufficiently wide driveways to allow the passage of the cars with the operating machines, and/or of other self-propelled feeding means, as well as of the operators.

On the other hand, the operating machines must be oversized, in order to be able to simultaneously work on 6, 8 or more rows of forms in a sufficiently fast way, while nevertheless remaining completely out-of-work for most of the working day as they have to wait for the previous or subsequent working steps to be completed.

Figures 5, 8:
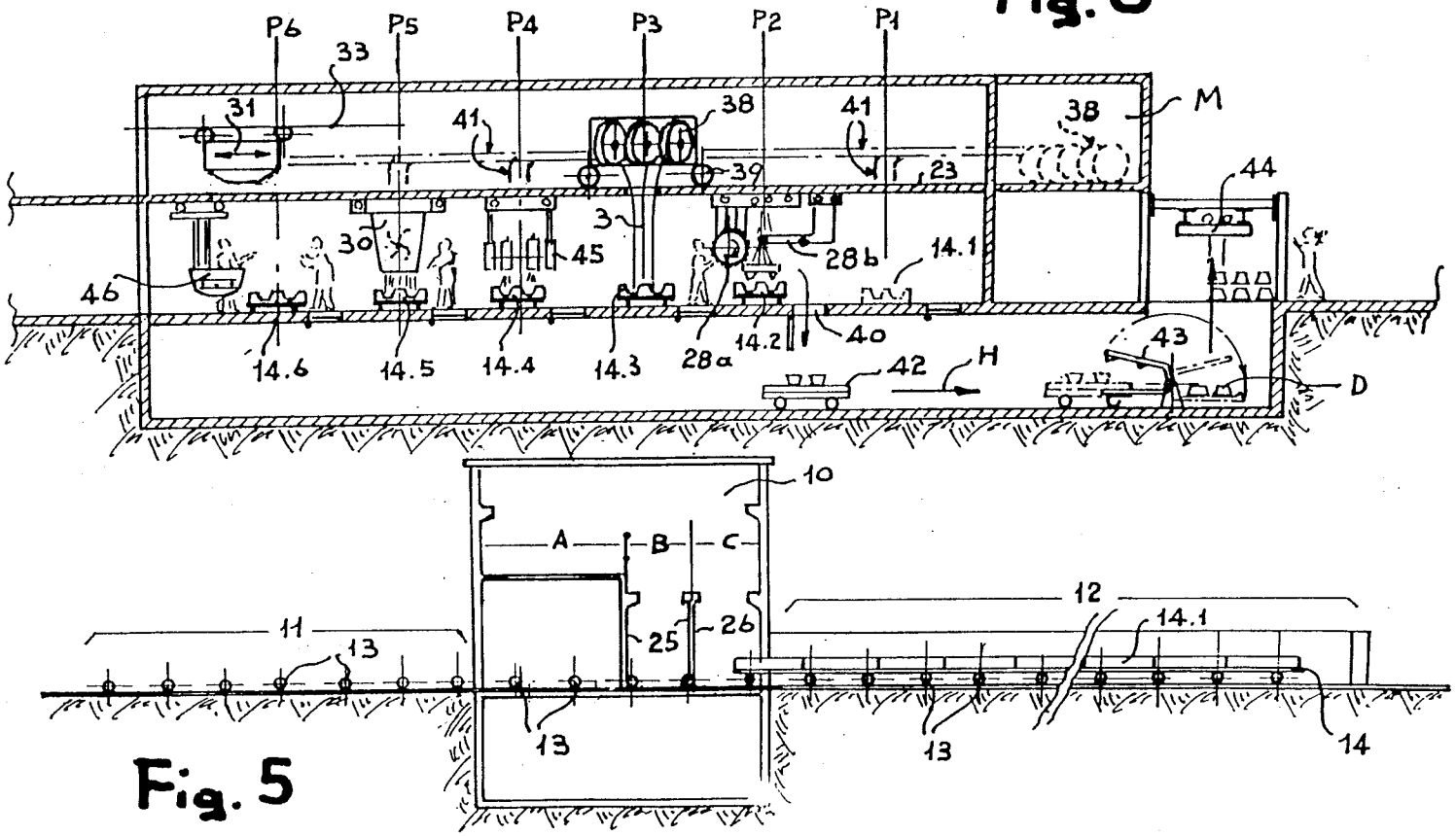
FIG. 5 is a longitudinal view, similar to that of FIG. 4*a*, showing a diagram of a plant according to the invention.
FIG. 8 shows a section of the working area, perpendicular to that of FIG. 7.

Whereas, the plant according to the present invention requires—as illustrated in FIG. 5—a relatively limited working area, and precisely that contained in the shed 10, and provides for two further areas, a service area 11 and a curing area 12, external to the shed. It is reckoned that, for the same number of rows of forms and thus, substantially, for an equal width of the shed, the length of said shed could be drastically reduced, for instance not exceed 10 to 15 m (but it could be even less, if one were to forgo the use of automatic transport systems for the operating machines, as better described hereinafter). To said shed length one should of course add the length of the service area (which can however be left uncovered) and that of the curing area (which can also be left uncovered, or anyhow be very simply covered for example with a fixed waterproof sheet).

Figures 6A, 6B:
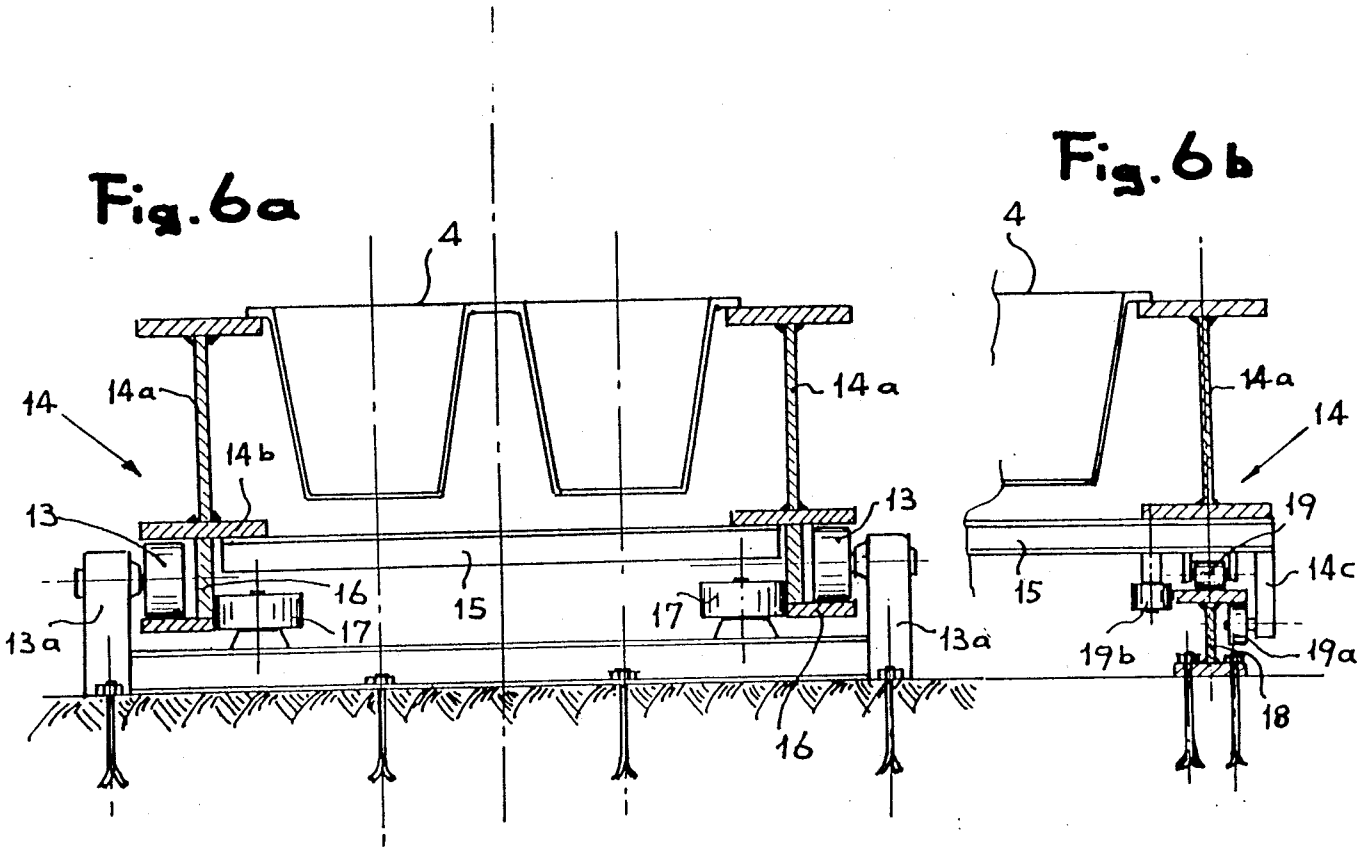
FIG. 6*a* and 6*b* are cross section views of two different embodiments of a sliding track and of the respective carriage slidable along the same.

These three areas 10, 11 and 12, comprise a plurality of parallel continuous working tracks, along which are apt to slide carriages 14 supporting the forms, as better described hereinafter. Each working track consists—according to the embodiment of FIG. **6*a*—of a plurality of wheels 13, mounted rotating on horizontal pivots carried at the top of uprights 13*a* fixed to the ground. In the embodiment of FIG. 6*b*, the track is instead formed by a pair of fixed rails 18**.

According to the invention, the carriage 14—which, at the beginning of the working cycle, is positioned in the service area 11—is progressively moved through the working area 10, where all the operations are carried out in succession on the forms, and then towards the curing area 12, or viceversa, according to the operational sequences better defined hereinafter with reference to FIG. **9*a***.

As diagrammatically illustrated in FIGS. **6*a* and 6*b*, the carriage 14 is formed of a pair of longitudinal side members 14*a*, having for instance an I-section and taking the flexural and axial compression stresses. The two longitudinal members 14*a* of the carriage 14 are connected by crosspieces 15**, positioned at regular intervals throughout the length of the carriage, so as to realize a very stiff structure in its whole.

To the two opposite ends of the carriage 14 there are associated tensioning means, of a type similar to the anchor plates 8 and 9 of known technique, and thus not illustrated. The prestressing strands 3 are anchored to said tensioning means, which are fixedly connected to the carriage 14 and thus movable therewith along the sliding tracks. The tensioning of the strands is guaranteed in known manner by hydraulic jacks which are caused to cooperate each time with a different carriage.

According to the embodiment of FIG. **6*a*, the carriage 14 has no wheels. In fact, under the base 14*b* of each longitudinal side member 14*a* there is welded an angle iron 16 forming, with the base 14*b*, a channel guide apt to engage the wheels 13 for the support and sliding of the carriage 14. Further wheels 17 are provided on the innermost side of the track defined by the wheels 13, said wheels 17 being mounted rotating on fixed vertical pivots and bearing with their periphery against the side of the angle irons 16 opposite to that facing the wheels 13**.

The wheels 13, as well as supporting the carriage 14, also guarantee its vertical restraint, while the wheels 17 guarantee the lateral retention of the carriage 14. This arrangement, besides supporting and guiding the carriage 14 in a correct and centred position, is also apt to prevent problems of elastic instability in the structure of the carriage, which is slender and highly compressed (combined bending and compressive stress condition, determined by the high tension of the reinforcement strands 3 anchored to the tensioning means fixedly connected to the carriage).

In the embodiment of FIG. **6*b*, the sliding track is instead formed by a pair of rails 18, having for example an I-section. In this case, the carriage 14 bears on the rail 18 with support and sliding wheels 19 of its own. The vertical restraint of the carriage is guaranteed by supplementary wheels 19***a*, carried by a projection 14*c* of the actual carriage and bearing against the lower surface of the upper flange of the I-rail. The horizontal retention is instead guaranteed by secondary wheels 19*b*, with vertical axis, also carried by the carriage 14. The assembly of wheels 19, 19*a* and 19*b*, equally prevents problems of instability in the structure of the carriage.

The forms 4 bear with their edges on the top surface of the longitudinal side members 14*a*. In the illustrated embodiment, the forms have a double configuration, that is, they allow to form a pair of sleepers. This configuration has proved in practice particularly favourable:

on one hand, as it facilitates the operations in the plant according to the invention, on the other hand, as it reduces the axial pressure imparted on the carriage by the tensioning force of the reinforcement strands 3 which, in the case of a pair of forms, amount to eight strands.

Figure 7:
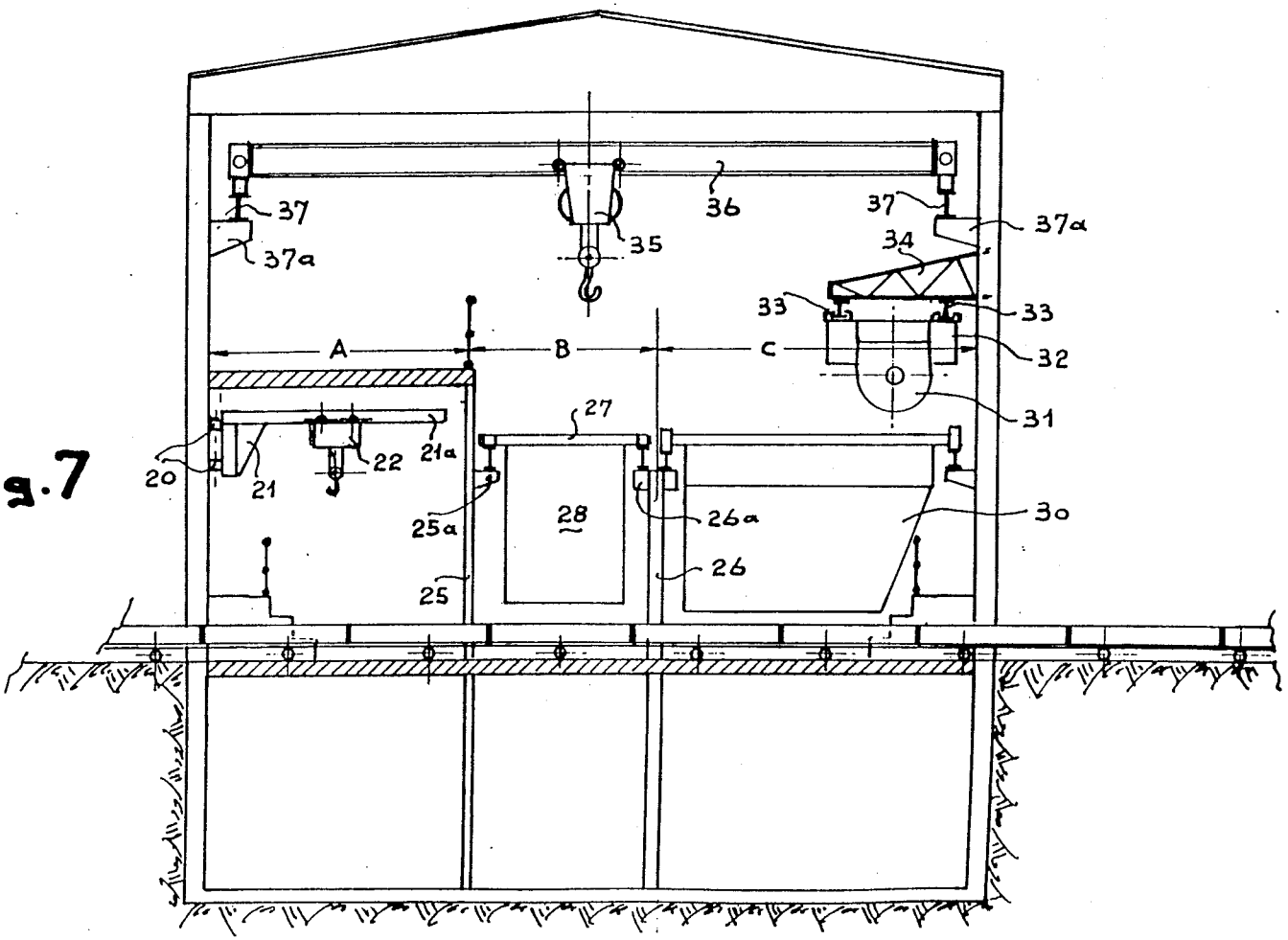
FIG. 7 shows a section of the working area of the plant, on an enlarged scale in respect of that of FIG. 5.

FIGS. 7 and 8 show an embodiment of a shed used as working area 10. As outlined in these figures—of which FIG. 7 is a longitudinal section, i.e. parallel to the sliding tracks, while FIG. 8 is a cross section and thus perpendicular to the previous one—the shed contains three driveways along which slide the operating machines.

The driveway A comprises a lateral rail 20, fixed to the wall of the shed, along which slides a truck 21 supporting a cantilevered crosspiece 21*a* along which slides a hoist 22. As clearly shown in the drawing, the truck 21 is slidable crosswise and the hoist 22 is slidable lengthwise (always in respect of the longitudinal axes of the sliding tracks). The function of the hoist 22 is better described hereinafter.

Furthermore in the driveway A, above the slab 23, there are arranged rolls 38 (see FIG. 8), which feed the wire strands forming the prestress reinforcements for the sleepers. The rolls 38 are in turn mounted on a carriage 39 slidable along the slab 23. Alternately, the rolls 38 can be arranged in a store M and the strands can be simply fed through guides, as better illustrated hereinafter.

The driveway B is delimited by two parallel sets of uprights 25, 26, carrying at the top stringers 25*a*, 26*a*, along which there are fixed rails for the support and sliding of a carriage 27 holding a shakeout apparatus 28 for drawing out the finished sleepers. Also this apparatus will be better described hereinafter.

In the driveway C there is mounted—supported similarly to the shakeout apparatus 28, and equally slidable crosswise—an apparatus 30, for instance in the form of a hopper, for casting the concrete.

Always in the driveway C, above the casting apparatus 30, a mobile wagon 31 is provided to feed the concrete, said wagon going backwards and forwards between a concrete mixing station (not shown) and said hopper 30. The wagon 31 is mounted on a suspended truck 32, which also slides crosswise along a pair of rails 33 carried by a plurality of brackets 34 overhanging from the shed wall.

Above all this equipment, there is also provided a service crane 35—of a type widely known per se—sliding lengthwise along a support transom 36, which is in turn slidable crosswise along rails 37 fixed onto brackets 37*a* positioned at the top of the two opposite sidewalls of the shed.

Of course, the above arrangement of a work-shed is only an example and many modifications could easily be introduced therein, according to the specific requirements of the plant designer. A very simple and economic solution could also be to fully eliminate the driveways equipped for the automatic motion of the operating machines, and to use the crane 35 for shifting the machines crosswise and positioning them each time in correspondence of the track in which the respective operation has to be carried out.

As illustrated in the cross section view of FIG. 8, a plurality of parallel working tracks P are arranged inside the shed 10, said tracks being shortly spaced one from the other and being marked by references P1, P2, P3, P4, P5, P6. FIG. 8 shows how, according to the fundamental principle of the invention, on each of the tracks the respective forms undergo a different working step; in particular, according to an arrangement illustrated by way of example:

In correspondence of the track P1, the carriage 14.1 is in the curing area 12, thus externally to the shed 10, so that none of the operating machines is cooperating therewith.

In correspondence of the track P2, the shakeout apparatus 28 is operating. This machine comprises a cutter 28*a*, which cuts the strands between one form and the next, and a seizing arm 28*b*, operating for instance with suckers. When the carriage 14.2 moves forward into the shed 10, it carries a first form in correspondence of the machine 28. The cutter 28*a* separates the pair of sleepers positioned in the first form from that positioned in the second form. When the arm 28*b* draws the two sleepers out of the first form, it lifts them and discharges them—through an opening 40 provided in the floor of the shed 10—beneath this latter, onto a service conveyor, consisting for example of a truck 42. The carriage 14.2 is then moved forward to an extent corresponding to the size of a form and the cutting and lifting operations are repeated. The truck 42 can be provided to house one or more pairs of sleepers; when fully loaded, it is moved forward in the direction of the arrow H until it reaches a tipping unit 43. This latter is apt to seize the sleepers, lift them from the truck 42 and overturn them in a position D, in which they can be drawn by a hoist 44 to be finished and stored.

While the shakeout apparatus 28 is operating on the carriage 14.2, the reinforcement strands 3 are stretched out on the carriage 14.3 in correspondence of the track P3. Said strands are unwound from the rolls 38 which, as already mentioned, are mounted on a carriage 39 slidable along the slab 23. This carriage is stopped just in correspondence of the track P3. The stretching out of the strands 3 thus takes place thanks to the relative motion of the carriage 14.3, which moves uniformly through the shed 10. As an alternative to this arrangement, the rolls can be fixedly positioned into a store M, provided on the side of the working area 10—or even placed on the actual slab 23—and from this position the strands can be supplied, through guide channels 41 (shown in dashed lines in FIG. 8), to the track where they are required.

While the above machines are operating on carriages 14.2 and 14.3, a machine 45 simultaneously operates in correspondence of the track P4, to prepare the forms positioned on the carriage 14.4 by providing for their cleaning and lubrication (with substances apt to facilitate subsequent removal of the sleepers). This machine, which can operate for example in correspondence of the driveway A, has not been illustrated in FIG. 7, as it can be transferred by means of the hoist 22, or it can very simply consist of a device supplying water and lubricant, which is manually operated by an operator.

Likewise, as the previous machines are operating on the respective tracks, the concrete feed hopper 30 operates in correspondence of the track P5, said hopper providing to cast the concrete in the forms supported by the carriage 14.5. The casting can be carried out continuously, while the carriage 14.5 is moving constantly forward in respect of the hopper 30, or discontinuously, one form at the time, so as to have a better control on the amount of concrete being poured in each form. As already said, the hopper 30 is fed by the wagon 31, 32, sliding along the rail 33, or by any other equivalent means;

Finally, always simultaneously with the previous machines, a machine operates in correspondence of the track P6 to introduce into the forms supported by the carriage 14.6 baffles, inserts, possible light reinforcements and/or anything else which may be required for the casting. A machine of this type does not appear in FIG. 7, as it could simply consist of a container 46 (FIG. 8) for the elements to be introduced, suspended to the hoist 22 of the driveway A (FIG. 7).

As can be noted, the heretofore described sequence of operations, following the order of the tracks P1 to P6, does not correspond to the sequence of operations as they should actually be carried out on a specific carriage. In actual fact, this circumstance is apt to place in evidence the high operational flexibility of the plant according to the invention, wherein the operations on the single tracks can be carried out following sequences which are established so as to make the most rational use of the plant itself, and not substantially in dependence of the operational sequence on a specific carriage being instead determined merely by production requirements.

Figure 9A:
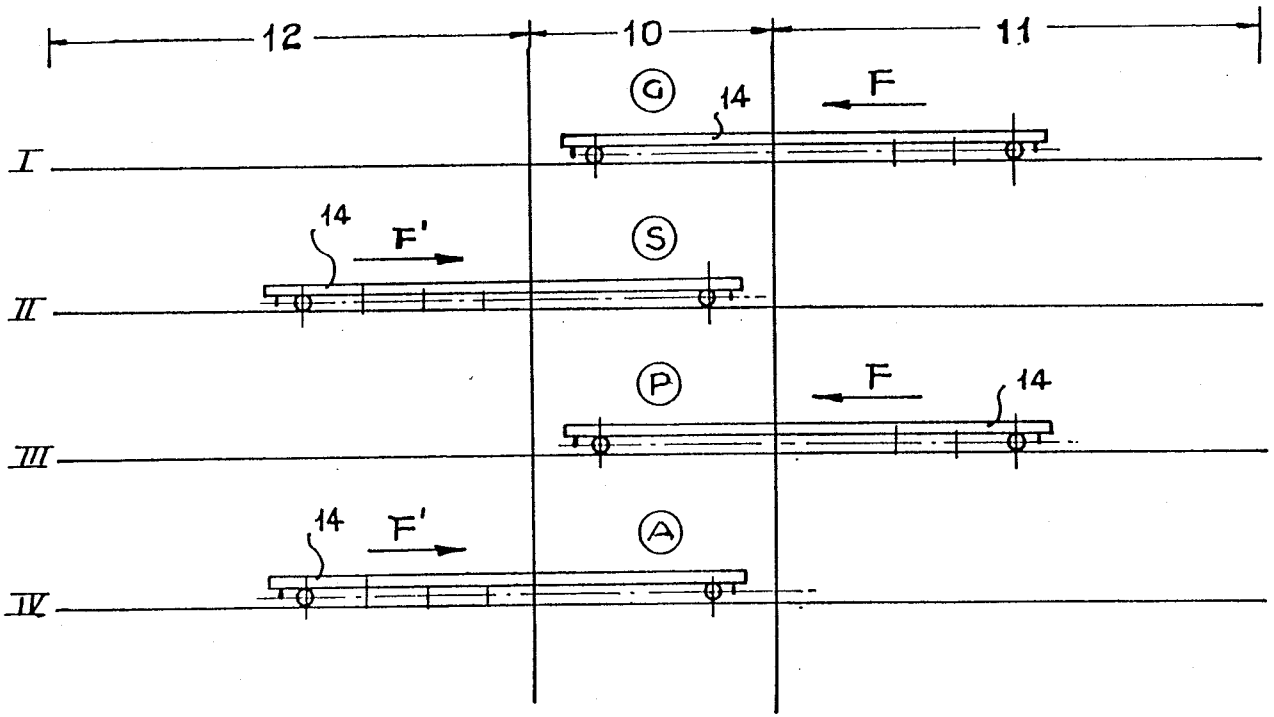
FIGS. 9*a* and 9*b* are diagrams showing, respectively, the working steps and the working times of the plant according to the invention.

FIG. 9*a* is a diagram showing the rational use which can be made of the different areas of the plant and of the different working steps, eliminating altogether the dead times for transferring the carriages from one working area to the next:

Line I shows the carriage 14—after the forms have been prepared and the reinforcement strands have been stretched out—being moved in the direction of the arrow F, to go through the working area 10 where the casting is carried out (step G); as it advances, the carriage 14 moves towards the curing area 12, where it remains for the time required for the concrete to cure;

Line II shows the carriage 14—after the concrete has cured—being moved in the direction of the arrow F′, to go through the working area 10 where cutting and shakeout are performed (step S); as it advances, the carriage 14 moves into the service area 11, until all the sleepers have been drawn out;

Line III shows the carriage 14—after the sleepers have been removed—being again moved in the direction of the arrow F, to go through the working area 10 where cleaning and lubrication of the forms is performed (step P); as this operation continues, the carriage 14 again moves into the curing area 12;

Line IV finally shows the carriage 14—after cleaning and lubrication of all the forms has been completed—being moved once more in the direction of the arrow F′, to go through the working area 10 where the reinforcement operation is carried out on all the forms (step A), so as to start again the working cycle from line I.

Figure 9B:
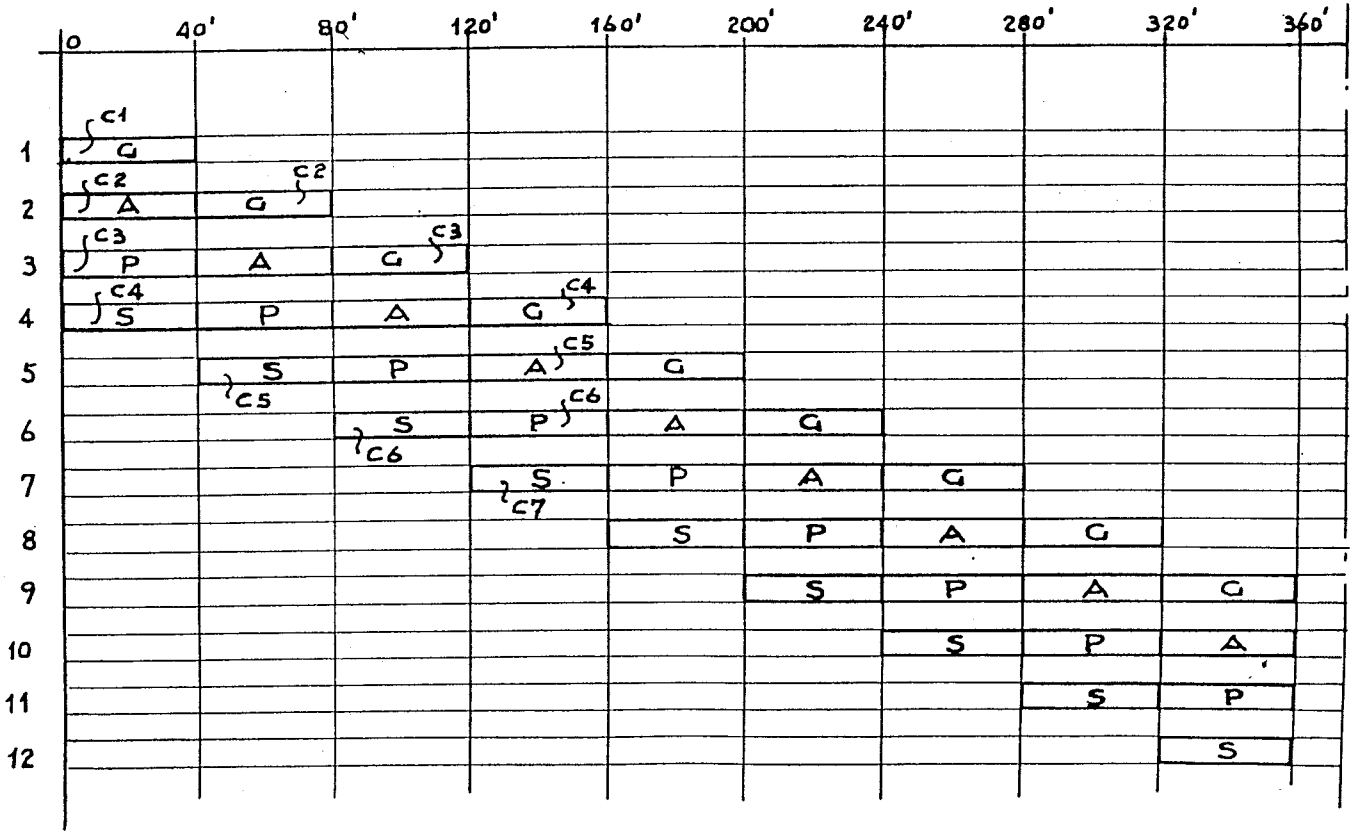

FIG. 9*b* shows a flow diagram of the working times, using a plant according to the invention equipped with twelve sliding tracks for as many carriages supporting forms, and referring to an operational sequence as illustrated in FIG. 9*a*. The working times are reported in abscissae, while the ordinates indicate the single carriages in the different working steps G, S, P, A. This flow diagram is meant to refer to a continuous working cycle (for instance, three shifts in 24 hours), but different flow diagrams can easily be imagined. As can be seen:

in the first working period, from 0′ to 40′, the following operations are carried out:
casting (G) on the carriage C1,
reinforcement (A) of the forms on the carriage C2
cleaning (P) of the forms on the carriage C3,
shakeout (S) of the sleepers on the carriage C4;

in the second working period, from 40′ to 80′, the carriage C1 is stationary for curing, while the following operations are carried out:
casting (G) on the carriage C2,
reinforcement (A) of the forms on the carriage C3,
cleaning (P) of the forms on the carriage C4,
shakeout (S) of the sleepers on the carriage C5;

in the third working period, from 80′ to 120′, the carriages C1 and C2 are stationary for curing, while the following operations are carried out:
casting (G) on the carriage C3,
reinforcement (A) of the forms on the carriage C4,
cleaning (P) of the forms on the carriage C5,
shakeout (S) of the sleepers on the carriage C6;

in the fourth working period, from 120′ to 160′, the carriages C2 and C3 are stationary for curing, while the following operations are carried out:
casting (G) on the carriage C4,
reinforcement (A) of the forms on the carriage C5,
cleaning (P) of the forms on the carriage C6,
shakeout (S) of the sleepers on the carriage C7;

and so forth, as results evident from FIG. 9*b*; the operations on the first carriage C1 start again only when enough time has passed for the concrete curing to have been completed.

It is evident that the period of 40 minutes, forseen for any one of the working steps G, S, P, A, is purely indicative. This period will generally correspond to the time required for the longest working step (except for the curing step, which takes an amount of time corresponding to a whole multiple of said basic floor to floor time).

From the above, it can be easily understood that, in addition to the remarkable advantages already pointed out previously, and in particular:

less investments on the structure of the shed, which is here reduced in size, and on the operating machines, which have less capacity, and less equipment for the forms, which can be reduced in number and be shifted from one carriage to the other;

uniform behaviour of the carriage and of the reinforcement strands in relation to the expansions produced by thermal excursions (this prevents the risk—present in known plants—of a change in the tensile characteristics of the strands in respect of the fixed tensioning means, before complete curing of the concrete, or even cracking of the strands due to a sudden temperature fall);

more rational and steady use of the operating machines;

there are also a number of other advantages which, though of minor importance, are certainly not to be neglected, and precisely:

more rational use of labour which, instead of moving in bulk from one operating machine to the next (as in the plants of known technique), remains operative on a given operating machine, with obvious advantages as far as skill in the work being performed;

more flexible use of the plant which, according to production requirements, can be entirely devoted to the production of a single product, or be employed with part of its carriages for producing a given product and with the other part for producing different products (which can besides be of the reinforced or non-reinforced type, and with simple or prestressed reinforcements);

possibility to gradually increase the capacity of the plant, always according to the actual requirements of growth of the plant itself, by varying both the number of the carriages and, possibly, their length.

It is anyhow understood that the invention is not limited to the particular embodiment described heretofore, but that different other arrangements can be provided, particularly for what concerns for example the crosswise displacements of the operating machines, all such modifications being considered within reach of a technician skilled in the art and thus falling within the protection scope of the invention itself.

I claim:

1. Plant to manufacture elongated concrete elements, the plant comprising:

(a) a plurality of parallel configured, longitudinally-extending rectilinear tracks;

(b) at least one elongated support carriage slidably displaceable along each of said tracks, each of said support carriages supporting a plurality of elongated forms arranged on said support carriage so as to establish at least one set of aligned, longitudinally-extending forms;

(c) means for positioning a reinforcement and prestressing strand along a longitudinal axis of each of said support carriages so as to extend through said aligned set of elongated forms;

(d) means for tensioning said reinforcement and prestressing strands, at least a portion of said reinforcement and prestressing strand tensioning means being mounted directly to an end of each of said carriages;

(e) a sheltered working area comprising a predetermined central portion of said plurality of tracks;

(f) a series of operating machines each for performing a different work operation on the forms, said operating machines being positioned in said sheltered working area and mounted above said tracks so as to be displaceable transversely across said tracks between a plurality of positions, each of the positions being substantially fixed with respect to a longitudinal axis of each of said tracks, each of said operating machines performing a predetermined work operation on said plurality of aligned forms while said supporting carriages are advanced along said tracks to displace the forms relative to said operating machines, said series of operating machines comprising at least one concrete casting machine for continuously casting concrete successively on the plurality of aligned forms of said carriage, and a machine including tensioning means for tensioning said reinforcement and prestressing strand; and (g) a curing area for said cast concrete forms positioned externally from said working area.

2. Plant as in claim 1, wherein each of said slidable carriages supports at least one side-by-side row of forms.

3. Plant as in claim 1, wherein said tensioning means for stretching said reinforcement and prestressing strands comprises anchor means for securing said strands, and at least one hydraulic jack anchored at one end of a corresponding one of said tracks, said anchor means being fixed to opposite ends of each of said carriages.

4. Plant as in claim 3, wherein each of said carriages is provided with a rigid support structure for resisting flexural and axial compression stresses.

5. Plant as in claim 1, wherein each of said tracks for the carriages supporting the forms comprises vertical restraint means having a plurality of support wheels rotatable on horizontal pivots carried by uprights fixed to a ground surface, each of the carriages further comprising two channel guides engagable with said wheels.

6. Plant as in claim 5, wherein each of said tracks further comprises lateral retention means for the carriages having a plurality of wheels rotatable on vertical pivots fixed to the ground surface for engaging said carriages.

7. Plant as in claim 1, wherein each of said tracks for the carriages supporting the forms comprises a plurality of rails, each carriage further comprising a plurality of main wheels bearing on said rails and being rotatable about horizontal pivots fixed to the carriage.

8. Plant as in claim 7, wherein each support carriage further comprises a plurality of supplementary wheels rotatable on horizontal pivots and bearing against a lower surface of said rails.

9. Plant as in claim 7, wherein each support carriage further comprises lateral retention means for the carriage that include a plurality of secondary wheels rotatable on vertical pivots and bearing laterally against said rails.

10. Plant as in claim 1, wherein said operating machines are movable along driveways transverse to said tracks for the carriages supporting the forms, such that the machines are carried, one independently from the other, above any one of said carriages.

11. Plant as in claim 10, wherein each said driveway comprises rails positioned above said tracks along which said operating machines are slidable.

12. Plant as in claim 1, wherein a service area is located on the side of the working area generally opposed to the curing area.

13. Plant as in claim 1, wherein said working area comprises a service conveyor positioned below a horizontal level of said tracks and means to transfer concrete elements drawn out of said forms onto said conveyor.

14. Plant as in claim 13, wherein said service conveyor comprises a truck movable transversely to and beneath said tracks.

15. Plant as in claim 13, the transfer means further comprising at least one tipping device to overturn said elements onto said service conveyor for carrying the elements toward a finishing station.

* * * * *